US007367425B2

(12) United States Patent
Rivers et al.

(10) Patent No.: US 7,367,425 B2
(45) Date of Patent: May 6, 2008

(54) GRADUATED POLE STRAP

(75) Inventors: Paul Rivers, Cullman, AL (US); Frederick Diggle, III, Mountain Brook, AL (US)

(73) Assignee: AT&T Delaware Intellectual Property, Inc., Wilmington, DE (US)

( * ) Notice: Subject to any disclaimer, the term of this patent is extended or adjusted under 35 U.S.C. 154(b) by 184 days.

(21) Appl. No.: 11/004,373

(22) Filed: Dec. 3, 2004

(65) Prior Publication Data

US 2006/0118360 A1 Jun. 8, 2006

(51) Int. Cl.
*E06C 5/00* (2006.01)

(52) U.S. Cl. ..... 182/93; 182/107; 182/129

(58) Field of Classification Search ..... 182/93, 182/107, 129
See application file for complete search history.

(56) References Cited

U.S. PATENT DOCUMENTS 376,558 A * 1/1888 Stahl ..... 33/15
4,545,460 A 10/1985 Byrd ..... 182/107
4,792,016 A 12/1988 Ingalsbe et al. ..... 182/107
4,920,659 A * 5/1990 Becher ..... 33/555.4
5,067,588 A 11/1991 Bendickson ..... 182/107
6,494,014 B2 * 12/2002 Lafrance ..... 52/745.05

OTHER PUBLICATIONS http://www.dicketool.com/Products/Laddermate/Laddermate_PDF/LM100_ProceduresW.pdf; Laddermate™ (LM100) Ladder Stabilizing Strap, produced by Dicke Safety Products, printed Jan. 25, 2005; 3 pages; known by others prior to Dec. 3, 2004.
http://www.dicketool.com/Products/Laddermate/Laddermate.htm; Laddermate™ Ladder Stabilizing Strap Model No. LM100, produced by Dicke Safety Products, Copyright © 2002, printed Jan. 26, 2005; 3 pages.

* cited by examiner

*Primary Examiner*—Alvin Chin-Shue
(74) *Attorney, Agent, or Firm*—Thomas, Kayden, Horstemeyer & Risley, LLP

(57) ABSTRACT

The graduated pole strap apparatus can be wrapped around a pole, tree or the like and secured on each end to the rails of a ladder. Further, it contains markings calibrated in proportion to the length of the ladder to show whether the ladder is secured at a safe inclination. For an extension ladder, the markings are calibrated based on the rung on which the fly-lock mechanism is locked on the face of the ladder of a particular length.

11 Claims, 4 Drawing Sheets

GRADUATED POLE STRAP

TECHNICAL FIELD

The present disclosure is generally related to ladder safety and, more particularly, is related to an apparatus and method for securing a ladder to a utility pole safely and at the proper inclination.

BACKGROUND

Effectively securing a ladder against a utility pole, a tree, or the like has long been a safety concern. Ladders are a leading cause of fall-related fatalities and other serious injuries. Ladder inclination is the angle of the ladder from the horizontal. If the ladder inclination is too steep, the risk of injury is increased because the ladder is more likely to fall backward under load. If the ladder inclination is not steep enough, the risk that the ladder will slide out from under the ladder user increases. Additionally, the possibility of the ladder twisting or kicking-out during use poses an additional risk that the user may lose balance and fall from the ladder.

To ensure that a ladder may be ascended safely, the ladder should be placed at an angle of approximately 75° from the horizontal. However, when setting a ladder against a pole, it is difficult to determine quickly and with certainty that the angle is correct. In addition, stabilizing straps, or lashes, have been used to secure ladders to utility poles. The stabilizing straps are wrapped around the pole and secured to the rails of the ladder. Various types of ladder inclination indicators have been developed to show that the angle of the ladder is correct. However, adjusting a stabilizing strap while monitoring an inclination indicator is unnecessarily time consuming and costly in terms of both materials and worker productivity.

Consequently, a need exists for an apparatus that overcomes theses and other problems.

SUMMARY

In response to these and other shortcomings, a graduated pole strap apparatus is disclosed as one example embodiment, among others. The graduated pole strap apparatus can be wrapped around a pole, tree or the like and secured on each end to the rails of a ladder. Further, it contains markings calibrated in proportion to the length of the ladder to show whether the ladder is secured at a safe inclination. For an extension ladder, the markings are calibrated based on the rung on which the fly-lock mechanism is locked on the face of the ladder of a particular length.

Other systems, methods, features, and advantages of the present disclosure will be or become apparent to one with skill in the art upon examination of the following drawings and detailed description. It is intended that all such additional systems, methods, features, and advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
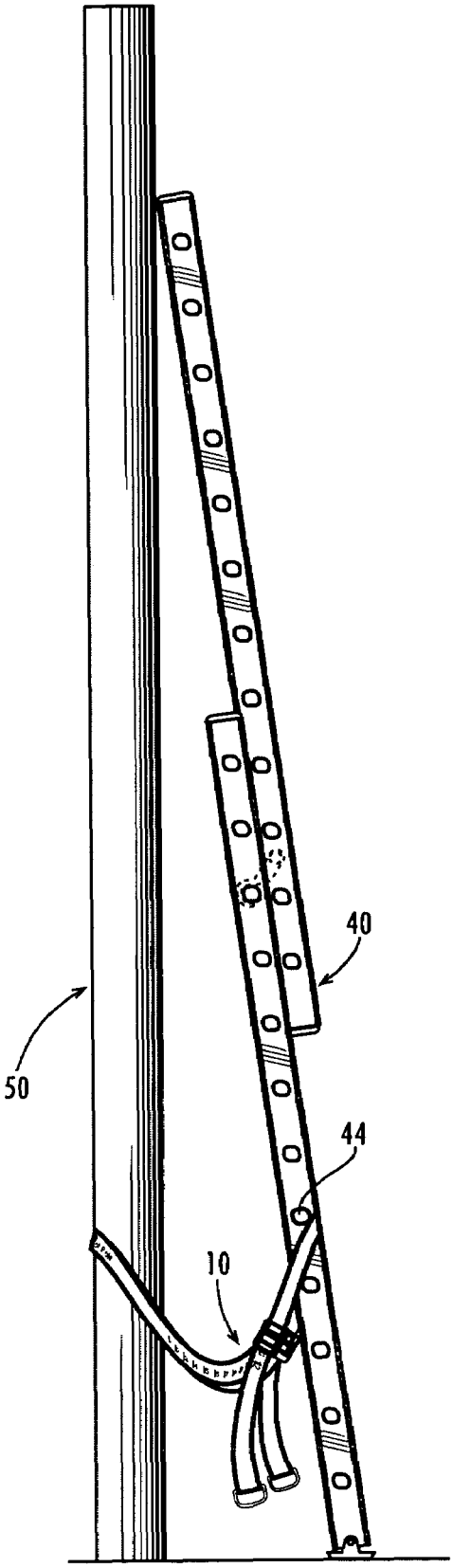
FIG. 1 is a side view of the graduated pole strap apparatus attached to a ladder and a pole prior to being adjusted.

With various aspects of the graduated pole strap apparatus having been summarized above, reference will now be made in detail to the description of the representative assembly illustrated in the drawings. While the graduated pole strap apparatus will be described in connection with these drawings, there is no intent to limit it to the embodiment or embodiments disclosed therein.

FIGS. 1 through 5 illustrate a graduated pole strap apparatus 10 that can be wrapped around a pole 50 and secured on each end to the rails 42 of a ladder 40, and contains calibration markings 26 to show whether the ladder 40 is secured at a safe inclination.

Figure 2:
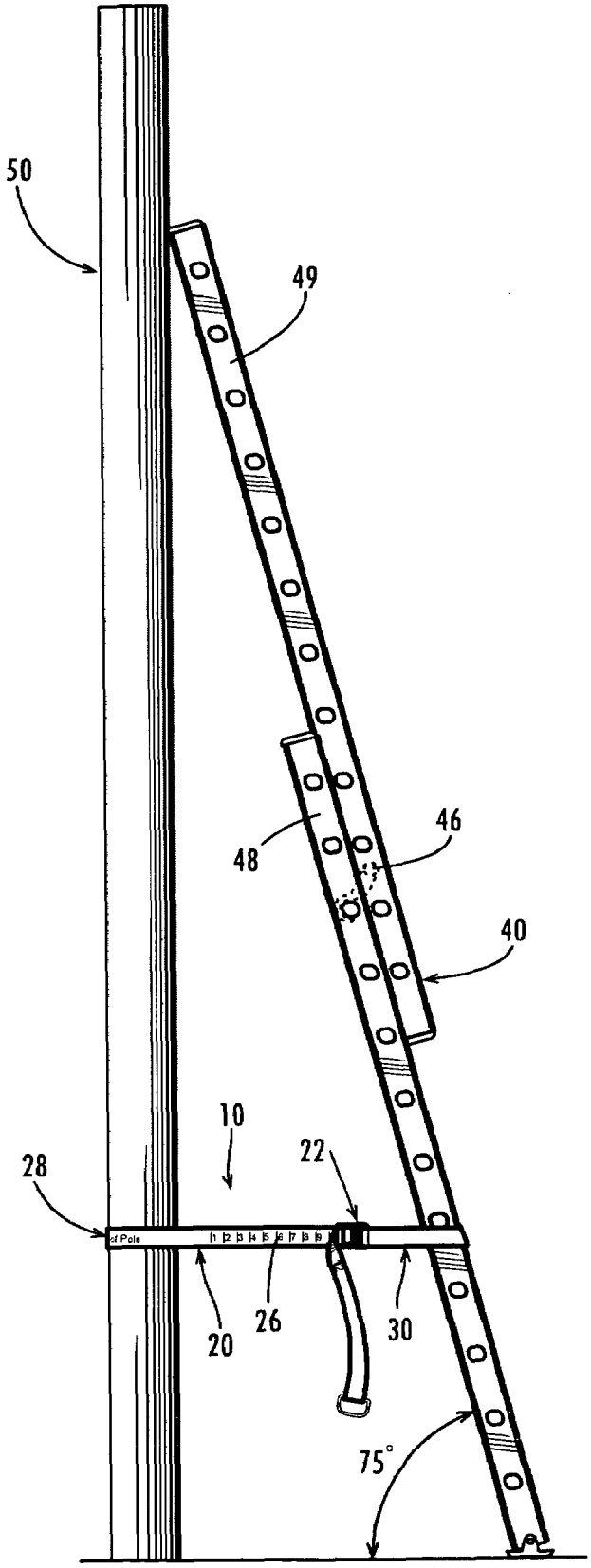
FIG. 2 is a side view of the graduated pole strap apparatus of FIG. 1 after being adjusted.

As illustrated in FIG. 1 and FIG. 2, the graduated pole strap apparatus 10 includes an adjustable strap 20 for connecting the apparatus 10 to a pole 50. FIG. 1 shows the apparatus loosely attached to a pole 50 and a ladder 40. The adjustable strap 20 is of a length that would wrap around a pole 50 and stretch to the ladder 40, for example, at the fifth rung 44 from each side of the pole 50. The adjustable strap 20 could be constructed from a woven canvas material, though other suitable materials could also be used as would be appreciated by one skilled in the art. The adjustable strap 20 comprises calibration markings 26 and a main buckle 22, each discussed further below, and is adjustable such that the user may be confident that the ladder 40 is secured at an inclination of approximately 75°, as shown in FIG. 2. When adjusted properly, the calibration marking 26 will correspond to the rung on which the fly-lock mechanism 46 of the ladder 40 is locked.

Figure 3:
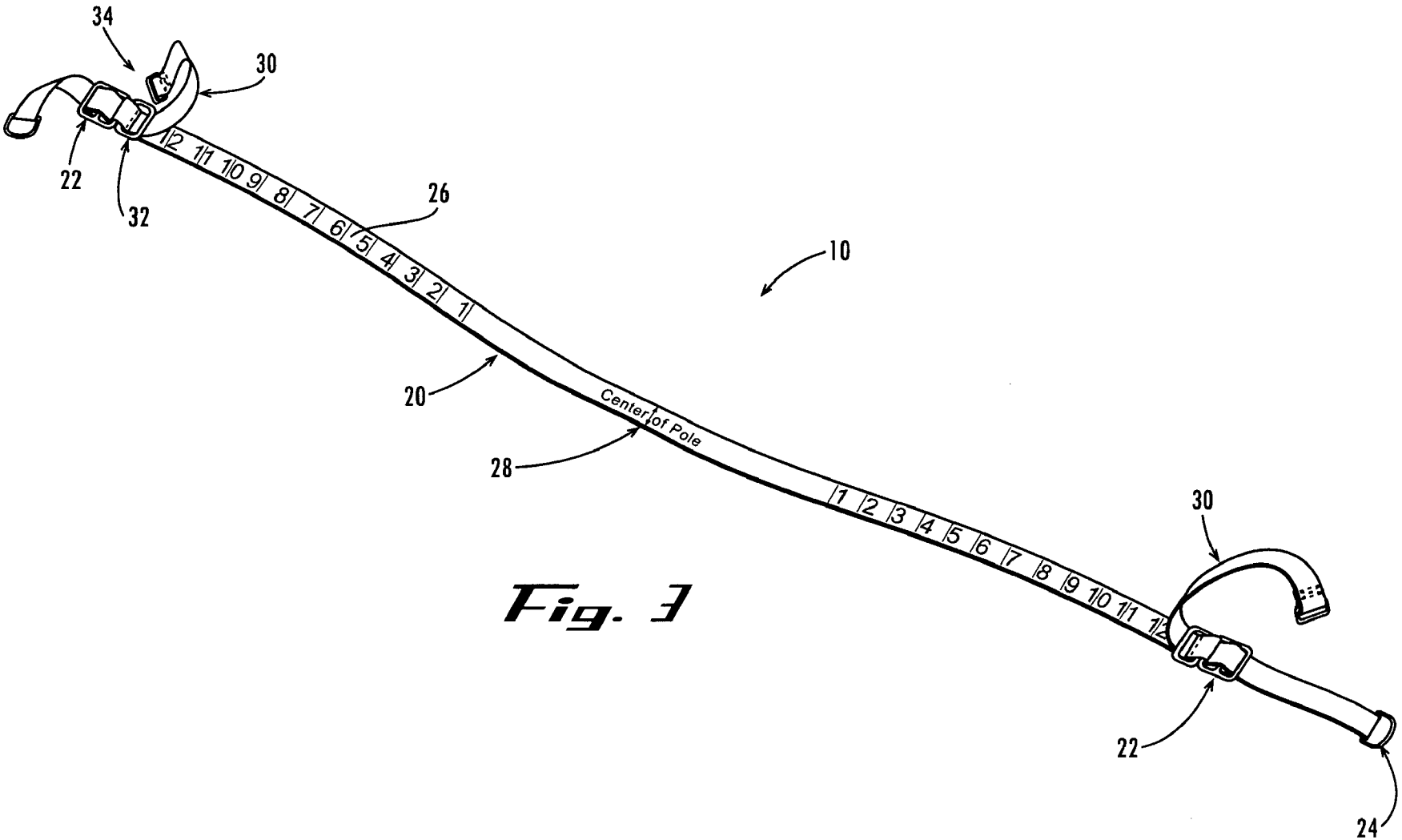
FIG. 3 is a side view of the graduated pole strap apparatus of FIG. 1 in an open and unattached configuration.

FIG. 3 shows a center of pole mark 28 at the center between the opposite ends of the adjustable strap 20. This mark is used to verify that the positioning of the adjustable strap 20 when wrapped around the pole 50 is such that the center of pole mark 28 is at the midpoint of the pole 50 opposite the ladder 40. It should be noted that constructing the adjustable strap 20 to such a length that it stretches to the ladder 40 at the fifth rung 44, provides for ease of use in attaching the graduated pole strap apparatus 10 to both the pole 50 and the ladder 40. A different design would allow the graduated pole strap apparatus 10 to be attachable to a different rung 44 of the ladder 40.

As illustrated in FIG. 3, the apparatus 10 further comprises a main buckle 22, located near each end of the adjustable strap 20, for adjusting the tension of the apparatus 10. The adjustable strap 20 contains a main buckle 22 near each end. The main buckle 22 could be a cinch buckle, adjustable buckle, slider buckle, side release buckle or any other suitable fastening mechanism that allows for adjusting the tension of the graduated pole strap apparatus 10.

Figure 4:
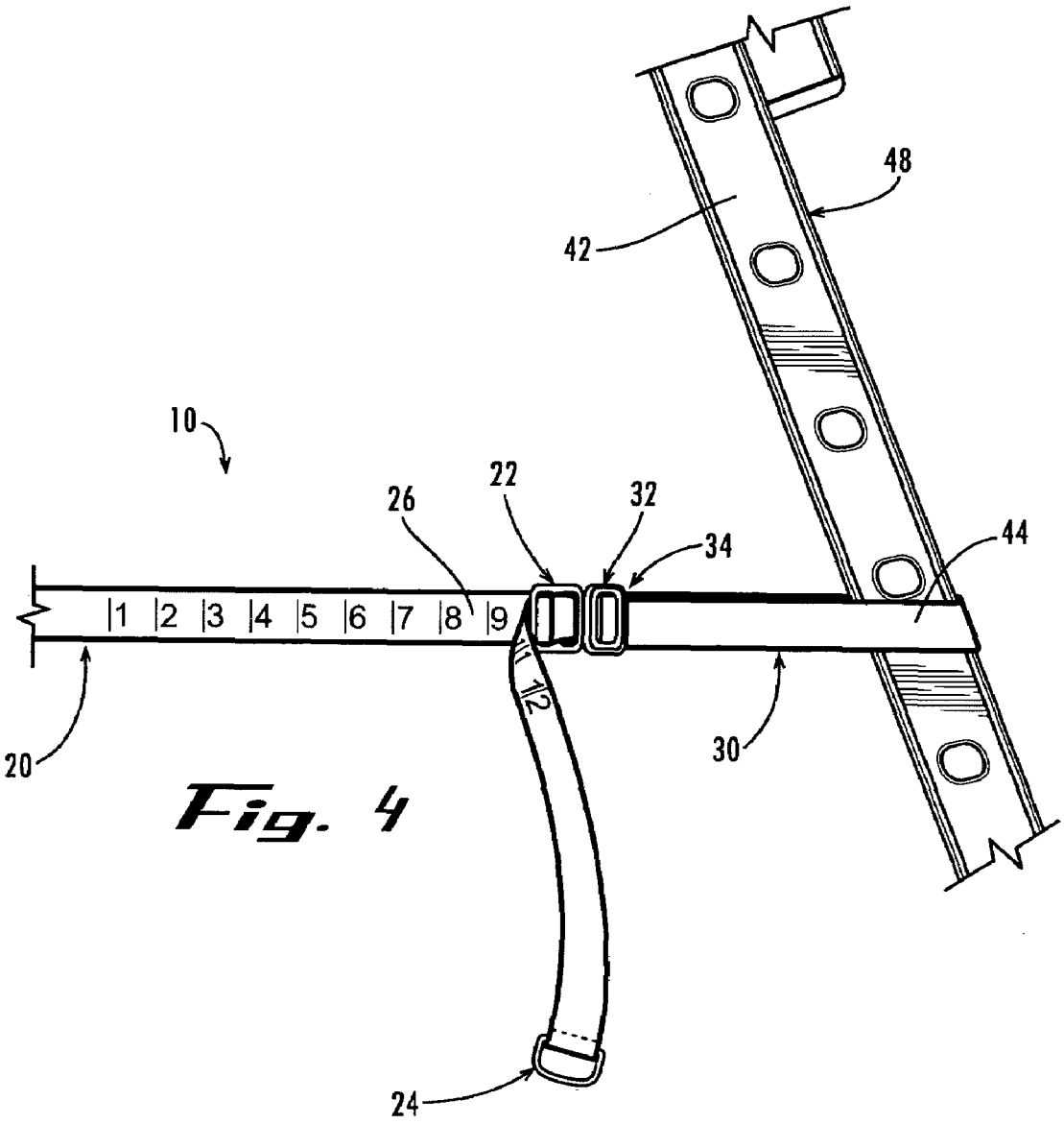
FIG. 4 is a close-up side view of the graduated pole strap apparatus affixed to a ladder and showing the markings.
Figure 5:
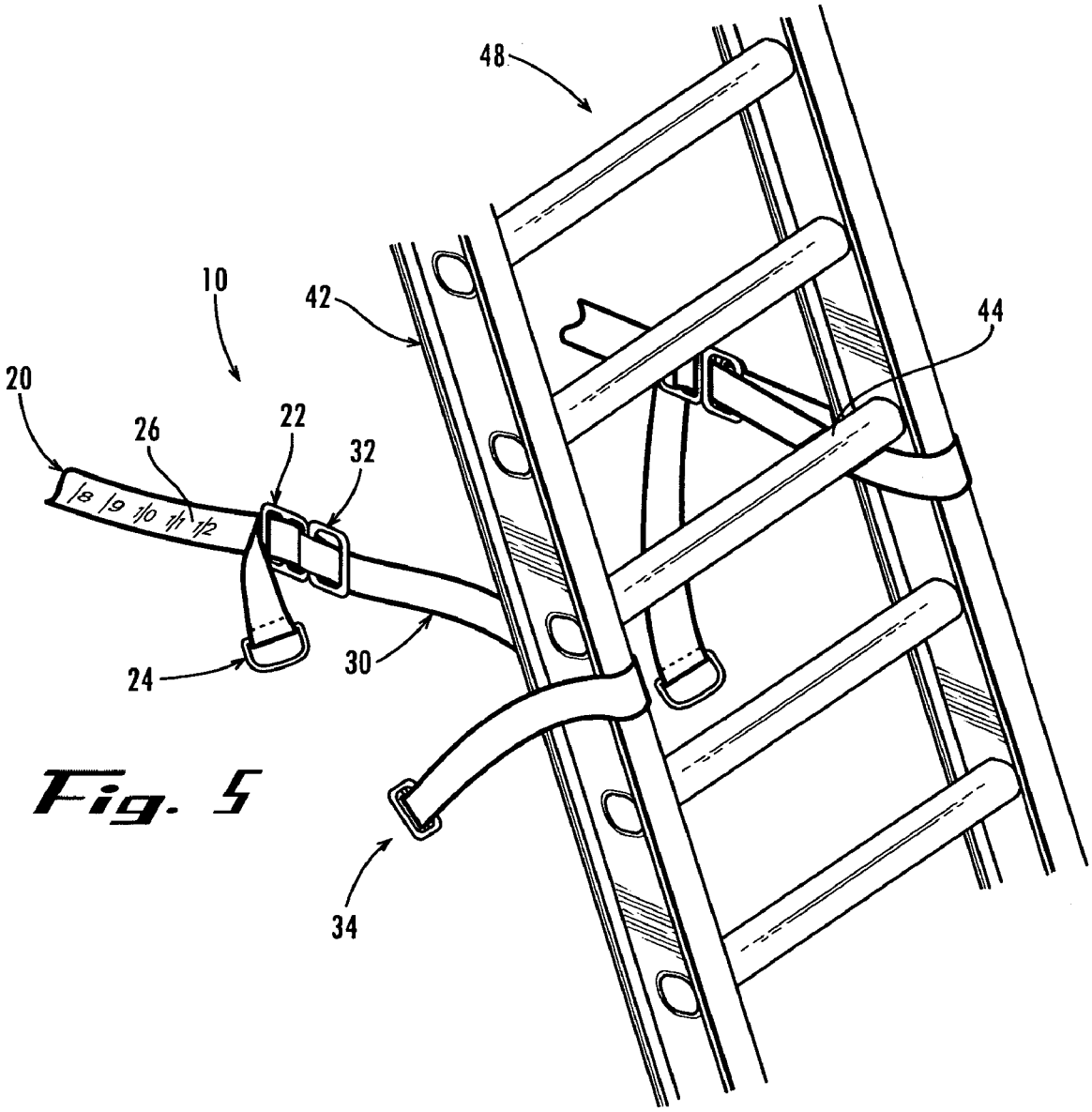
FIG. 5 is a perspective view of the graduated pole strap apparatus showing one end attached to a ladder and the other end not yet fastened.

As shown in FIG. 3, FIG. 4 and FIG. 5, the apparatus 10 further comprises end straps 30 coupled to each main buckle 22, for securing the apparatus 10 to the ladder 40. As with the adjustable strap 20, the end straps 30 could be constructed from a woven canvas material, though other suitable materials could also be used as would be appreciated by one skilled in the art. The end straps 30 are of such length as to be wrapped around the rail 42 of the ladder 40 to secure the adjustable strap 20 of the graduated pole strap apparatus 10 to the ladder 40. In one example, a securing buckle 32 is attached to one end of the end strap 30 and that same end of the end strap 30 is also coupled to the main buckle 22 near one end of the adjustable strap 20. The securing buckle 32 could be any type buckle suitable for securing a fastening device. The opposite end of the end strap 30 contains a fastening mechanism 34 for fastening to the securing buckle 32. One combination for securing the end strap 30 would be a rectangular securing buckle 32 along with a rectangular fastening mechanism 34 that can be maneuvered through the securing buckle 32 and pulled tight to secure the fastening mechanism 34 into place. Other combinations would include a D-ring or other suitable type buckle as the securing buckle 32 while utilizing a carabiner, a C-clip, or other type snap hook as the fastening mechanism 34. One of ordinary skill in the art will recognize that many combinations may be employed for the securing buckle 32 and the fastening mechanism 34. Alternatively, the fastening mechanism 34 could be a hook, clip or other type fastening device for securing the end of the end strap 30 to the rung 44 of the ladder, rather than wrapping around the rail 42 and back to the securing buckle 32.

As another alternative, the adjustable strap 20 could provide for securing the apparatus 10 to the ladder 40. As an example the adjustable strap 20 could be of sufficient length to wrap each end of the adjustable strap 20 around one of the rails 42 of the ladder 40 to secure the graduated pole strap apparatus 10 to the ladder 40 using an appropriate main buckle 22. Alternatively, the adjustable strap 20 could be of such length to secure the adjustable strap 20 to a rung 44 of the ladder 40 via a hook, clip or other type fastening device.

As illustrated in FIG. 3 and FIG. 4, the apparatus 10 further comprises calibration markings 26 on the adjustable strap 20, for indicating that the apparatus 10 is adjusted to signify proper ladder inclination. The calibration markings 26 could be painted, printed, or embossed onto the adjustable strap 20, among others. Alternatively, items such as brads, buttons, or other suitable indicia could be affixed to the adjustable strap 20.

The spacing between the calibration markings 26 is dependent upon the length of the ladder 40 with which the graduated pole strap apparatus 10 is to be used. To be used safely, a ladder 40 should be secured at an angle of approximately 75°. For an angle of 75°, the ratio of the ladder length to the horizontal distance from the base of the pole 50 to the foot of the ladder 40 is 4:1. For a standard ladder 40, the distance between rungs 44 is 12 inches with an additional six inches above and below the two-end rungs. A typical extension ladder includes two sections, the face or lower portion and the fly or upper portion. Thus, for each adjustment of the fly 49 up by one rung 44, the horizontal distance at the base of the ladder must extend by 3 inches. However, for ease of use the graduated pole strap apparatus 10 would normally be calibrated to attach at or near eye-level height. Calibrating the graduated pole strap apparatus 10 to the fifth rung 44 would mean that the 5 ½ feet below the fifth rung 44 would not be included when determining the ladder-length to horizontal ratio. As an example, for a 24-foot extension ladder 40, the overlap between the face 48 and the fly 49 would normally be 3 feet. At maximum extension, the ladder 40 would be 21 feet long. The calibration ratio would be 186 inches (15 ½ feet) to 46 ½ inches and the fly-lock mechanism 46 would be locked on the tenth rung 44. The distance of the graduated pole strap apparatus 10 would be 46 ½ inches from the pole 50 to the ladder 40 at the fifth rung 44. Of course, the actual length of the adjustable strap 20 portion of the graduated pole strap apparatus 10 would be twice the distance from the pole 50 to the ladder 40, plus enough slack to wrap around the outside of the pole 50, another full turn around the pole 50, and also some additional length at each end for gripping the adjustable strap 20 to pull it through each main buckle 22. The exact calibration markings 26 would, of course, vary in accordance to whether the adjustable strap 20 is looped completely around the pole 50 in its use. For example, the graduated pole strap apparatus 10 could be wrapped around the outside of the pole 50 without looping completely around the pole 50, thus constituting only a one-half turn wrap around the pole 50 with no full turn wrap around the pole 50. For a one-half turn wrap, the graduated pole strap apparatus 10 would be attached to the ladder 40 with one end of the apparatus 10, stretch around the outside of the pole 50, and attach to the ladder 40 with the other end of the apparatus 10. A typical embodiment would allow for one full turn wrap around the pole 50 in addition to the one-half turn wrap, thus constituting a one-and-one-half turn wrap. For a one-and-one-half turn wrap, the graduated pole strap apparatus 10 would be attached to the ladder 40 with one end of the apparatus 10, stretch around the outside of the pole 50, wrap a complete turn around the pole 50, and attach to the ladder 40 with the other end of the apparatus 10. Further, and as noted previously, the graduated pole strap apparatus 10 could be calibrated in a manner to attach to the ladder at a different rung 44 than the fifth rung 44 as would be recognized by one of ordinary skill in the art.

The calibration markings 26 on the adjustable strap 20 would be such that the calibration mark 26 corresponding to the tenth rung 44 would be at the main buckle 22 when the adjustable strap 20 is pulled tight. If the ladder 40 were shortened by one rung 44, then the calibration marking 26 corresponding to the ninth rung 44 would be at the main buckle 22 when the fly-lock mechanism 46 is locked on the ninth rung 44 and the adjustable strap 20 is pulled tight. Similar calibration markings 26 on the adjustable strap 20 will correspond to each rung 44 on which the fly-lock mechanism 46 may be locked. It should be emphasized that the calibration markings 26 on the adjustable strap 20 must be calibrated for a particular maximum ladder length. The markings for a 24-foot extension ladder will not apply to a 28-foot extension ladder. Of course, calibration markings 26 for different length ladders 40 could all be provided on the same graduated pole strap apparatus 10, but would need to be clearly delineated as to which ladder length each group of calibration markings 26 applied. One embodiment would be to color code the calibration markings 26 for different length ladders 40.

Use of the graduated pole strap apparatus 10 requires leaning the ladder 40 against a pole 50, a tree, an I-beam, or the like as illustrated in FIG. 1. The distance from the base of the pole 50 to the foot of the ladder 40 should be a distance slightly less than one-fourth the length of the extended ladder 40. The adjustable strap 20 of the graduated pole strap apparatus 10 should be wrapped around the pole once such that the center of pole mark 28 is at the midpoint of the pole 50 opposite the ladder 40 at the fifth rung 44. Each end of the adjustable strap 20 should be extended toward the corresponding rail 42 of the ladder 40 at the fifth rung 44. Each end strap 30 should be wrapped around the corresponding rail 42, under the fifth rung 44 and then connected via the fastening mechanism 34 to the securing buckle 32 as illustrated in FIG. 1 and also in FIG. 5. Alternatively, a graduated pole strap apparatus 10 with no end straps 30 would require wrapping the ends of the adjustable strap 20 around the corresponding rail 42, under the fifth rung 44 and then secured to the main buckle 22. The graduated pole strap apparatus 10 is now attached, but with some degree of slack.

After the graduated pole strap apparatus 10 has been attached to the pole 50 and to the ladder 40, the adjustable strap 20 should be tightened until the appropriate calibration mark 26 is at the main buckle 22 on each end of the adjustable strap 20. The appropriate calibration mark 26 is the one corresponding to the rung 44 on which the fly-lock mechanism 46 is locked. For example, if the fly-lock mechanism 46 is locked on the eighth rung 44 of the face 48, then the adjustable strap 20 should be tightened until the eighth calibration mark 26 is at the main buckle 22 on each end of the adjustable strap 20.

Finally, the feet of the ladder 40 should be adjusted away from the base of the pole 50 until the graduated pole strap apparatus 10 is tight as shown in FIG. 2. The ladder 40 is now at or very near a 75° inclination and is safely secured for use. To remove the graduated pole strap apparatus 10, the ladder 40 should be lifted slightly and pushed inward toward the pole 50. The tension will release from the apparatus 10, and it can be removed.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

Therefore, having thus described the disclosure, at least the following is claimed:

1. An apparatus for securing a ladder, comprising:

an adjustable strap portion including a centering mark, the centering mark indicating a position on the adjustable strap portion for removably attaching the adjustable strap portion to a fixed structure, the adjustable strap portion further including a first plurality of adjustment marks and a second plurality of adjustment marks, the first plurality of adjustment marks and the second plurality of adjustment marks indicating a position for attaching the adjustable strap portion to a ladder of a first length, the adjustable strap portion further including a third plurality of adjustment marks and a fourth plurality of adjustment marks, the third plurality of adjustment marks and the fourth plurality of adjustment marks indicating a position for attaching the adjustable strap portion to a ladder of a second length, wherein the ladder of the first length and the ladder of a second length are different lengths;

a first adjustment component coupled to the adjustable strap portion, the first adjustment component adjustably aligns with the first plurality of adjustment marks when used with the ladder of a first length, the first adjustment component adjustably aligns with the third plurality of adjustment marks when used with the ladder of a second length; and a second adjustment component coupled to the adjustable strap portion, the second adjustment component adjustably aligns with the second plurality of adjustment marks, when used with the ladder of a first length, the second adjustment component adjustably aligns with the fourth plurality of adjustment marks when used with the ladder of a second length, wherein the adjustable strap portion includes a first end and a second end, the first end and second end adjustably attaching the adjustable strap portion to the respective ladder.

2. The apparatus of claim 1, wherein the first plurality of adjustment marks and the second plurality of adjustment marks include corresponding identifications, the corresponding identifications configured to identify a position on the ladder for removably attaching the apparatus.

3. The apparatus of claim 1, and wherein the centering mark is positioned substantially midway between the first end and the second end.

4. The apparatus of claim 1, wherein the first adjustment component includes a securing buckle.

5. The apparatus of claim 1, wherein the first adjustment component includes a fastening mechanism.

6. The apparatus of claim 1, wherein the second adjustment component includes a securing buckle.

7. The apparatus of claim 1, wherein the second adjustment component includes a fastening mechanism.

8. The apparatus of claim 1, wherein the first plurality of adjustment marks and the second plurality of adjustment marks are configured to facilitate a desired ladder angle, relative to horizontal, when the apparatus is removably attached to the ladder and the fixed structure.

9. The apparatus of claim 1, wherein the first plurality of adjustment marks and the second plurality of adjustment markings are configured to facilitate a ladder angle of approximately 75°, relative to horizontal, when the apparatus is removably attached to the ladder and the fixed structure.

10. An apparatus for securing a ladder, comprising:

an adjustable strap portion including a centering mark, the centering mark indicating a position on the adjustable strap portion for removably attaching the adjustable strap portion to a fixed structure, the adjustable strap portion further including a first plurality of adjustment marks and a second plurality of adjustment marks, the first plurality of adjustment marks and the second plurality of adjustment marks, including corresponding identifications indicating ladder rungs and a second plurality of adjustment marks, the first plurality of adjustment marks and the second plurality of adjustment marks indicating a position for attaching the adjustable strap portion to a ladder of a first length, the adjustable strap portion further including a third plurality of adjustment marks and a fourth plurality of adjustment marks, the third plurality of adjustment marks and the fourth plurality of adjustment marks being indicating a position for attaching the adjustable strap portion to a ladder of a second length, wherein the ladder of the first length and the ladder of a second length are different lengths;

a first adjustment component coupled to the adjustable strap portion, the first adjustment component adjustably aligns with the first plurality of adjustment marks when used with the ladder of a first length, the first adjustment component adjustably aligns with the third plurality of adjustment marks when used with the ladder of a second length; and a second adjustment component coupled to the adjustable strap portion, the second adjustment component adjustably aligns with the second plurality of adjustment marks, when used with the ladder of a first length, the second adjustment component adjustably aligns with the fourth plurality of adjustment marks when used with the ladder of a second length, wherein the apparatus facilitates securing of the ladder to the fixed structure, such that the ladder is positioned at an angle of 75°, wherein the adjustable strap portion includes a first end and a second end, the first end and second end adjustably attaching the adjustable strap portion to the respective ladder.

11. The apparatus of claim 10, and wherein the centering mark is positioned substantially midway between the first end and the second end.

* * * * *